US005488391A

United States Patent [19]

Favot et al.

[11] Patent Number: 5,488,391

[45] Date of Patent: Jan. 30, 1996

[54] METHOD AND DEVICE FOR THE OPTIMIZING OF THE PERFORMANCE CHARACTERISTICS OF A LIQUID CRYSTAL DISPLAY MATRIX SCREEN AS A FUNCTION OF THE ANGLE OF OBSERVATION

[75] Inventors: Jean-Jacques Favot, Martignas/Jalles; Jean-Pierre Fontan, Cadaujac; Jean-Noël Perbet, Eysines, all of France

[73] Assignee: Sextant Avionique, Meudon La Foret, France

[21] Appl. No.: 962,702

[22] Filed: Oct. 19, 1992

[30] Foreign Application Priority Data

Oct. 22, 1991 [FR] France ..... 91 13011

[51] Int. Cl.[6] ..... G09G 5/00; G09G 3/36

[52] U.S. Cl. ..... 345/156; 345/87

[58] Field of Search ..... 340/705, 713, 340/784; 358/88, 91, 92; 345/6–9, 156, 87

[56] References Cited

U.S. PATENT DOCUMENTS

| | | | |
|---|---|---|---|
| 4,385,807 | 5/1983 | Perbet et al. . | |
| 4,390,244 | 6/1983 | Hareng et al. . | |
| 4,427,997 | 1/1984 | Hareng et al. . | |
| 4,430,650 | 2/1984 | Billard et al. . | |
| 4,525,708 | 6/1985 | Hareng et al. . | |
| 4,525,709 | 6/1985 | Hareng et al. . | |
| 4,535,327 | 8/1985 | Hareng et al. . | |
| 4,569,575 | 2/1986 | LePesant et al. . | |
| 4,649,504 | 3/1987 | Krouglicof et al. | 340/705 X |
| 4,653,858 | 3/1987 | Szydlo et al. . | |
| 4,668,051 | 5/1987 | Mourey et al. . | |
| 4,701,021 | 10/1987 | LePesant et al. . | |
| 4,722,601 | 2/1988 | McFarlane | 340/705 X |
| 4,732,873 | 3/1988 | Perbet et al. . | |
| 4,810,637 | 3/1989 | Szydlo et al. . | |
| 4,818,052 | 4/1989 | LePesant et al. . | |
| 4,824,216 | 4/1989 | Perbet et al. . | |
| 4,870,486 | 9/1989 | Nakagawa et al. | 358/92 |
| 4,897,715 | 6/1990 | Beamon | 358/88 |
| 5,014,982 | 5/1991 | Okada et al. | 273/435 |
| 5,053,764 | 10/1991 | Barbier et al. . | |
| 5,157,548 | 10/1992 | Monnier et al. . | |
| 5,172,222 | 12/1992 | Plantier et al. . | |

FOREIGN PATENT DOCUMENTS

| | | |
|---|---|---|
| 0272018 | 6/1988 | European Pat. Off. . |
| 0305287 | 3/1989 | European Pat. Off. . |
| 0420727 | 4/1991 | European Pat. Off. . |
| 2173079 | 10/1986 | United Kingdom . |

OTHER PUBLICATIONS

James D. Foley, "Interfaces for Advanced Computing," Scientific American, Oct. 1987, vol. 257, No. 4, pp. 127–135.

Pollack, A., "For Artificial Reality, Wear a Computer", New York Times, Apr. 10, 1989, pp. D1 and D5.

Sutherland, I. E., "A Head–mounted Three Dimensional Display," Fall Joint Computer Conference, 1968, pp. 757–763.

Wright, J., "Alter States," Computer Graphics, Dec. 1989, pp. 77, 78, 81–83.

Howard Rheingold, Virtual Reality, Summit Books, New York, 1991, pp. 104–113 and 140–141.

*Primary Examiner*—Ulysses Weldon

*Attorney, Agent, or Firm*—Oblon, Spivak, McClelland, Maier, & Neustadt

[57] ABSTRACT

The disclosed device comprises an image circuit formed by an image generator, a micro-zone processing unit, a screen interface and an LCD screen. To optimize the performance characteristics of the screen as a function of the angle of observation, the position of the observer is detected (by a detector) and, as a function of this position, the appropriate profile of luminosity of the micro-zones of the screen is selected.

6 Claims, 6 Drawing Sheets

REFERENCE MICRO-ZONE

CODE 00

SLIGHTLY ENHANCED MICRO-ZONE

CODE 01

MEDIUM ENHANCED MICRO-ZONE

CODE 10

GREATLY ENHANCED MICRO-ZONE

CODE 11

METHOD AND DEVICE FOR THE OPTIMIZING OF THE PERFORMANCE CHARACTERISTICS OF A LIQUID CRYSTAL DISPLAY MATRIX SCREEN AS A FUNCTION OF THE ANGLE OF OBSERVATION

BACKGROUND OF THE INVENTION

The present invention relates to a method and to a device for the optimizing of the performance characteristics of a liquid crystal display matrix screen as a function of the angle of observation.

One problem that is often encountered by the users of liquid crystal display (LCD) screens, using especially those using twisted nematic liquid crystals, is the deterioration of the legibility of the images displayed when the observer moves away from an axis of observation normal to the screen.

This deterioration is characterized by a fall in contrast and a colorimetrical drift (entailing a desaturation or reversal of the colors).

This phenomenon is chiefly related to the fact that an LCD screen possesses a limited field of observation.

This field of observation is even further reduced when images containing shades of gray are displayed, as is the case for example in synthetic imaging. This effect necessitates an anti-aliasing type of processing operation to improve image quality.

In the prior art, this lowering of the performance characteristics is compensated for by a overall adjustment of the voltages used to address the liquid crystal display screen. This is done by means of a control potentiometer placed in the vicinity of the screen.

An object of the invention is a method by which optimum legibility of the images shown on a liquid crystal display screen can be obtained automatically, whatever may be the observer's position with respect to the screen, hence whatever may be the direction of observation. An object of the invention is also a device for the implementation of this method.

SUMMARY OF THE INVENTION

The method according to the invention, for the optimization of the performance characteristics of a liquid crystal display matrix screen as a function of the angle of observation consists in:

- dividing the observation space, represented by a hemisphere, before the screen, into elementary zones corresponding to the different positions in which the observer may be placed in order to look at the image,

- associating a particular processing operation of the image to be shown on the screen with each zone, in determining, for each zone, a set of micro-zones themselves formed by several pixels of the screen, the luminance level of each pixel and the chrominance level of each micro-zone of the screen being determined experimentally as a function of the angle of observation to obtain optimum legibility,

- memorizing these values and then,

- in normal use, detecting the position of the observer with respect to the screen and modifying at least one of the parameters of the processing of the image to be presented on the screen as a function of the values that are memorized and that correspond to the detected angle of observation.

The device according to the invention comprises a device for detecting the observer's position with respect to the screen, said device being connected by a processing device to a device for the weighting of luminosity and/or colorimetry characteristics of the images to be displayed on a liquid crystal display screen, the processing device determining the data needed for the weighting from information elements given by the detection device.

BRIEF DESCRIPTION OF THE DRAWINGS

The present invention shall be understood more clearly from the following description of an embodiment, taken as a non-restrictive example and illustrated by the appended drawings wherein.

MORE DETAILED DESCRIPTION

Figure 1:
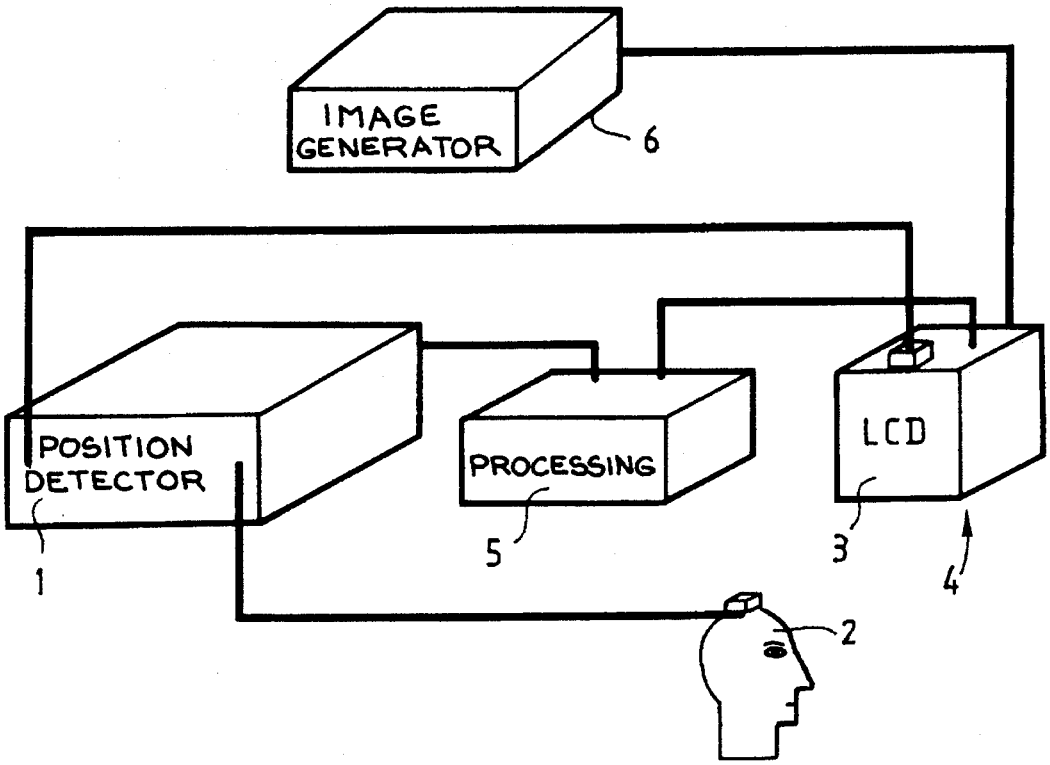
FIG. 1 is a simplified block diagram of an optimization device according to the invention.

FIG. 1 shows the block diagram of the device of the invention. This device essentially comprises: a device 1 for the detection of the position of the observer's head 2, a liquid crystal display (LCD) screen 3 forming part of a display device 4, which is connected to the detection device 1 by a processing device 5. The display device 3 is furthermore connected to an image generator 6 (which is a generator of synthetic and/or video images).

A description shall be given here below of different known devices for the detection of an observer's head, which could be used as the device 1. These devices are:

* An electromagnetic type detection device:

An electromagnetic position detecting device is generally formed by three elements:

- firstly, a reference source, also called a radiator, the role of which is to emit a reference magnetic field thus localizing the position of the origin and orientation of the 3D reference system related to the space in which the observer's head may move. This source is generally placed in the vicinity of the display screen.

- secondly, a position sensor with the role of receiving, in three directions of space, the reference radiation emitted by the source:

The level of energy received in the three directions of space is characteristic of the position and orientation of the sensor with respect to the reference source.

This sensor is generally carried by the observer.

- thirdly, a control unit, the role of which is to control the source and the electromagnetic sensor, process the signals coming from the sensor in order to extract therefrom the information elements on positions (three distances) and orientation (three angles) of said sensor with respect to the source, transmit these information elements cyclically and automatically on a serial type of computer link at the rate of 40 Hz for example.

The mean performance values of such devices, for a source-sensor distance<700 mm are:

- positioning precision>7 mm (mean value);
- precision of orientation>1.5° (mean value).

* An electro-optical type detection device:

An electro-optical type of position detecting device is generally constituted by:

- an optical emission source, such as for example a light-emitting diode emitting infra-red radiation at a solid angle of 180°.

This source is generally carried by the observer.

- two photosensors with a sensitive surface area of about 10 mm×10 mm, associated with an optical system enabling the source to be imaged on the active surface of the sensors.

Each detector is used to ascertain the position of the source in one plane of space.

The intersection of two judiciously chosen planes of space enables the third dimension to be determined.

These photosensors are generally located in the vicinity of the display screen.

- a control unit, the role of which is to compute the position of the source in the observation space from the information elements given by the sensors and to send out this position (three distances) cyclically and automatically on a serial type of computer link at the rate of 30 Hz for example. The precision of such devices is of the order of 1 mm for an observation distance of 1 m.

Any other position detection device may be used in the invention, even if its performance characteristics are lower than those of the foregoing two devices. It is also possible to use devices for detecting the direction in which the observer is looking.

For example, a device having a precision of over 20 mm for an observation distance of i m enables the positions of the boundaries of the different zones to be localized with a precision higher than 1.2°.

The display device 3 is of the type described in the French patent application No. 2 619 982 filed by the present Applicant. This known device is advantageously modified as described here below so that it can function in real time with high definition, the screen memory being used to carry out the correlation of the micro-zones, this screen memory being organized in a manner that is identical to that of the pixels of the micro-zones, and being associated with an addressing bus organized in matrix form.

Figure 2:
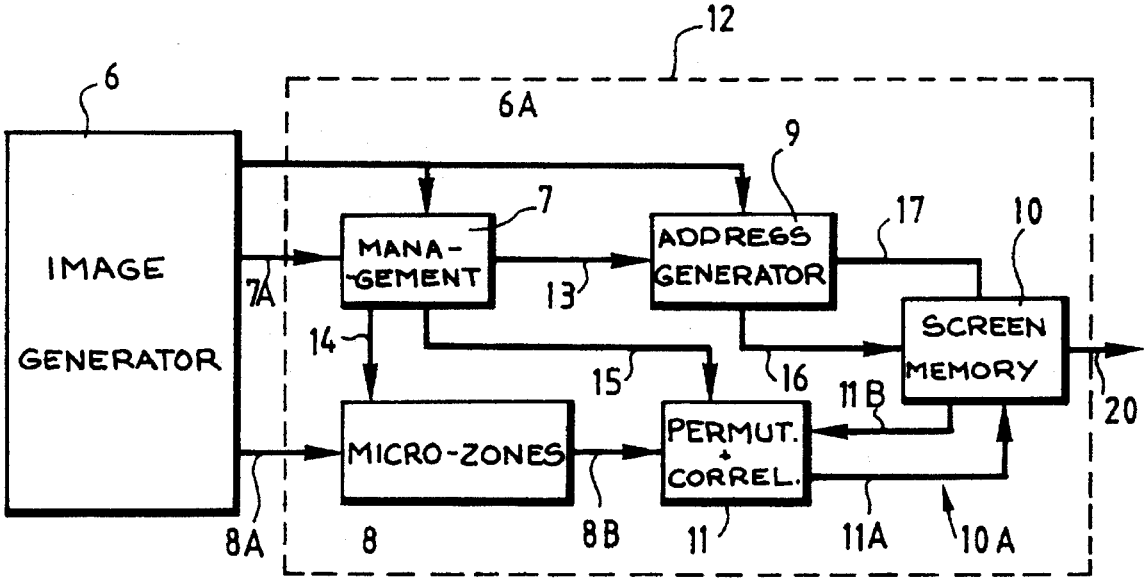
FIG. 2 is a block diagram of a processing circuit of the device of the invention.

FIG. 2 shows the block diagram of an embodiment of the control device of the screen 3, forming part of the display device 4 (namely a circuit forming part of the unit 12 described here below with reference to FIG. 7).

This control device is connected to the image generator 6. This generator 6 is connected by a line 7A to a management circuit 7 and by a bus 8A to a micro-zone generator 8. The generator 6 is furthermore connected, by an addressing control line 6A, to the management circuit 7 and to an address generator 9. This generator 9 addresses a screen memory 10 and is connected by a bus 10A to a permutation and correlation circuit 11. The bus 10A has a link 11A towards the memory 10 and a link 11B towards the circuit 11.

The functional unit comprising the elements 7 to 11 shall herein be called a unit of processing by micro-zones and shall be given the general reference 12.

The management block 7 fulfils a variety of functions. Through the line 13, it controls the address generator 9 depending on the mode of access to the unit 12, whether it is writing access for image processing operations or reading access for image display operations. On the line 14, the block 7 provides the generator 8 with the micro-zone selection parameters, which are established as mentioned in the document FR-A-2 619 982, the selection being done on the basis of image data given by the generator 6 on the bus 8A. Through the line 15, the block 7 controls the permutation means, described here below, of the block 11.

For a quad structure display unit, the micro-zone selection parameters are given on six bits, namely two bits for the coding of the quad structure and four bits for the coding of the observation conditions. For a trio structure display unit, these parameters are given on four bits for the coding of the trio structure and two bits for the coding of the observation conditions.

The block 7 also controls the screen memory 10 by means of the address generation block 9 and by means of the line 16, and addresses it by an addressing bus 17.

The screen memory 10 (FIG. 3) is constituted by a matrix of elementary memories, or memory packages, $\mathbf{18}^1$ to $\mathbf{18}^{16}$, organized in a manner identical to that of the pixels of the processing micro-zones with, in this case, sixteen RAM memories with a capacity of 64 K words of 4 bits each. The addressing bus 17 for addressing the memory 10 is divided into a column address bus 19C and a row address bus 19L and enables the simultaneous addressing of all the packages (for example in 30 ns) to write or read a matrix of pixels having a same structure as the processing micro-zones. For example, during the writing of a micro-zone in the screen memory 10, the pixels of the micro-zone are thus written respectively in all the elementary memories of the screen memory. All the elementary memories of a same column receive the same address through the bus 19C and all the elementary memories of a same row receive the same address through the bus 19L.

It will be noted that the information elements got from the reading of the screen memory 10, for the display on the screen, have come on a line 20, sequentially, by means (since the memory is a matrix memory) of a multiplexer 21 controlled by the line 16. The presenting of the pixels, on a row of the display screen for example, is done by the simultaneous sending of the succession of the four pixels, having the same row address, belonging to the four respective elementary memories of the corresponding row of the screen memory. The column addresses are herein incremented by 4 after each access to the screen memory. The rows of the screen memory are herein read 4 by 4, i.e. the row addresses are incremented by 4 every 4 lines.

By convention, and other conventions may be envisaged, the basic row and column addresses delivered by the generator 6 on the line 6A correspond to the coordinates, on the display screen, of the point common to the four central pixels of the associated micro-zone. The addresses of the different elementary memories $\mathbf{18}^1$ to $\mathbf{18}^{16}$ are determined on the basis of the coordinates X, Y of the pixel of the screen to be processed, delivered herein by the synthetic generator of symbols, or by the analog-digital converter associated with the video generator.

In image processing mode, the generator 9 herein gives 4 column addresses $ADRX_1$ -$ADRX_4$ and 4 row addresses ADRY -ADRY , in this case on 8 bits, the coordinates $X^1$ and $Y^4$ being given on 10 bits each, in the following non-exclusive way according to the invention:

$ADRX_1=(X+1)/4$ for the 1st column of packages;
$ADRX_2=X/4$ for the 2nd column of packages;
$ADRX_3=(X-1)/4$ for the 3rd column of packages;
$ADRX_4=(X-2)/4$ for the 4th column of packages;
$ADRY_1=(Y+1)/4$ for the 1st column of packages;
$ADRY_2=Y/4$ for the 2nd column of packages;
$ADRY_3=(Y-1)/4$ for the 3rd column of packages;
$ADRY_4=(Y-2)/4$ for the 4th column of packages.

In the screen display mode, the basic address X, Y is produced in the generator 9 in order to prompt, as described here above, a reading of the memory screen, the addresses applied to the elementary memories being determined as in reading mode.

Figure 3:
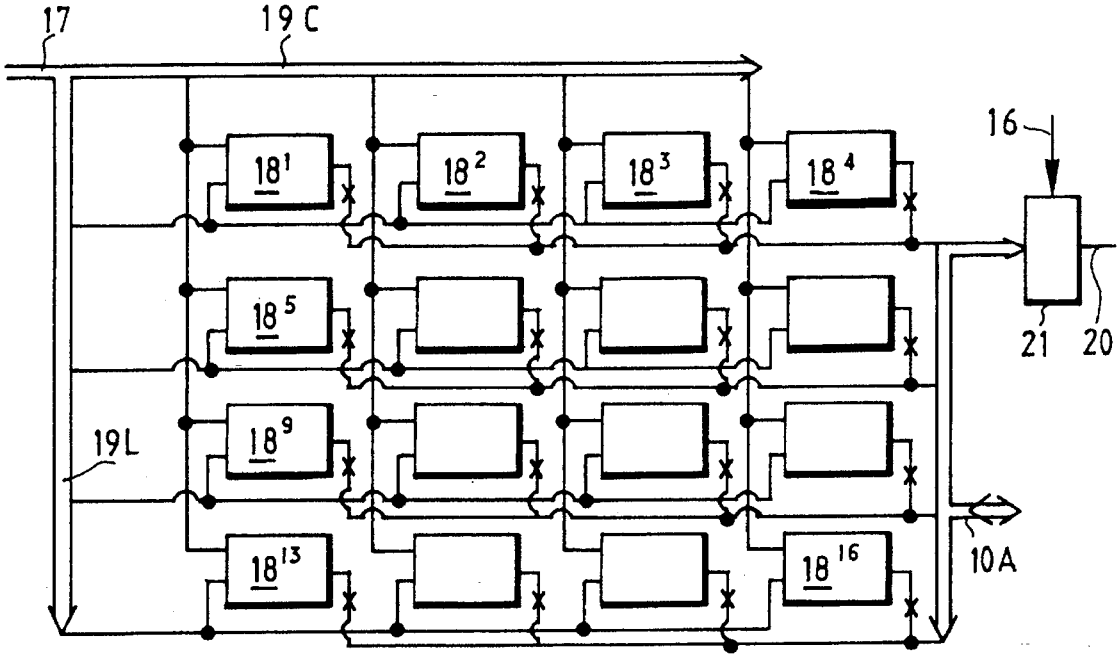
FIGS. 3 and 4 are respectively block diagrams of the screen memory and of the correlation circuit of the circuit of FIG. 2.
Figure 4:
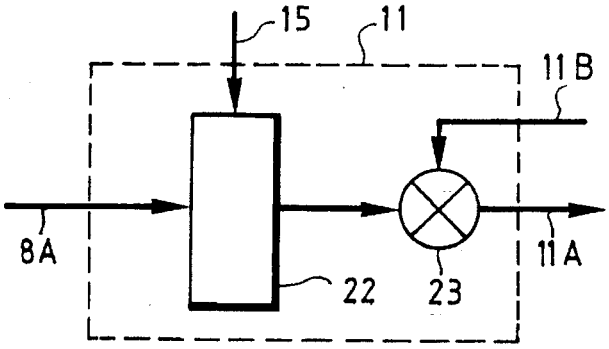

In the circuits 22, which are for example of the "PAL" type, the block 11 (FIG. 4) carries out the permutation of the data elements provided, on the line 8B, by the micro-zone generator 8 under the control, by the line 15, of the management block 7 and in the circuits 23, which are for example of the "PAL" type, the block 11 carries out the correlation of the data elements thus reorganized with the data elements read in the screen memory, by the line 11B, before the writing, through the line 11A, of the micro-zones correlated in the screen memory 10, the lines 11A and 11B being grouped together, at the screen memory 10, in the bus 10A (FIG. 3). Before correlation, the permutation circuits 22 set up coherence between the micro-zones coming from the micro-zone generator 8 and those read in the screen memory 10, so that the respective pixels having a same color correspond to one another and can be correlated.

For example, the sixteen elements of a micro-zone given by the generator 8 are referenced by the first sixteen letters of the alphabet arranged as follows:

| | | | |
|---|---|---|---|
| A | B | C | D |
| E | F | G | H |
| I | J | K | L |
| M | N | O | P |

Figure 5:
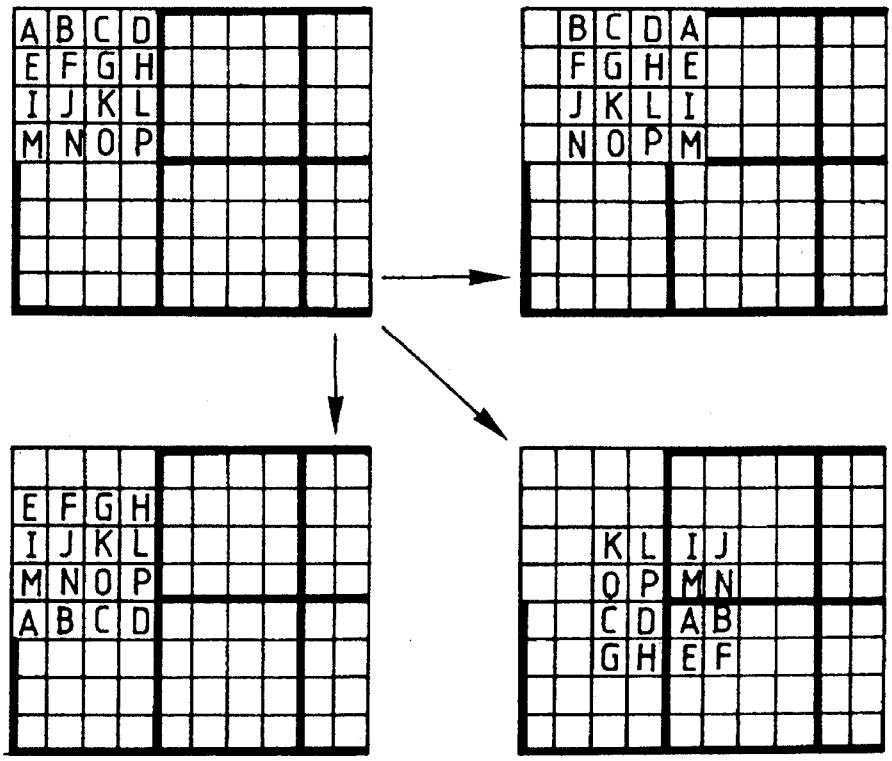
FIG. 5 is a diagram explaining the addressing of the screen memory of the device of the invention, for different positions of a micro-zone.

FIG. 5 shows four positionings of micro-zones in the screen memory corresponding to four different addressings X, Y. The box at the top left-hand corner shows the initial position of the micro-zone for coordinates X, Y giving identical addresses in all the packages of the screen memory 10. In this position, there is a direct correspondence between the elements of the micro-zone and those of the matrix read in the screen memory 10: there is no permutation to be done. The box at the top right-hand corner in FIG. 5 illustrates the block of elements read in the screen memory corresponding to an incrementation by one unit of the coordinate X, namely a rightward horizontal shift by one pixel; the correspondence between the elements of the memory and those of the micro-zone implies a leftward shift of these elements by one element:

| | | | |
|---|---|---|---|
| B | C | D | A |
| F | G | H | E |
| J | K | L | I |
| N | O | P | M |

Thus, in the horizontal direction, four cases of permutation are possible, depending on the necessary shift, from 0 to 3, taking into account the value of X. This is also the case in the vertical direction, taking into account the value of Y. On the whole, for any coordinates X, Y of the center of the micro-zone, sixteen different cases of permutation may arise under the control, by the line 15, of the management block 7. The box at the bottom left-hand corner of FIG. 5 shows the micro-zone with an incrementation by one unit of the coordinate Y. The box at the bottom right-hand corner shows the micro-zone with an incrementation by two units of the two coordinates X and Y.

The correlation circuits 23 work in parallel on all the elements of the micro-zone and of the matrix of memory elements. Herein, by a line 11B, they implement the function SUP(A, B) or SUM (A, B) for a pair formed by a pixel of the micro-zone and the corresponding pixel read in the screen memory. In the case of the function SUP(A, B), it is the pixel with the greatest luminance that is re-recorded in the screen memory by the line 11A.

The working of the processing unit 12 is of the random type (synthetic image) or of the sequential type (video image) at input and, in this case, of the type that is sequential at output. It could, however, also be random at output. It will be noted that the sequential display is particularly well suited to flat color matrix screens such as liquid crystal display (LCD) screens.

Figure 6:
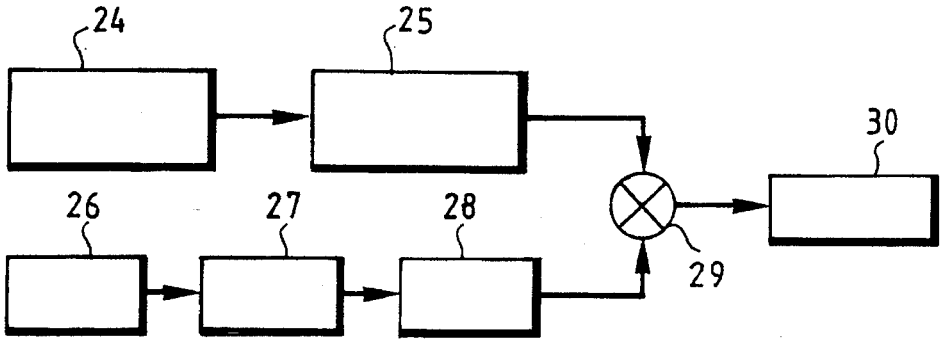
FIG. 6 is a diagram of the different steps in the processing of micro-zones according to the invention.

With reference to FIG. 6, the processing by micro-zones comprises a step 24 for the determination of the addresses of the screen memory 10 followed by a step 25 for the reading of the memory, a step 26 for the determining of the micro-zone selection parameters followed by a micro-zone generation step 27 and a permutation step 28, a correlation step 29 following the two steps 25 and 28, which end substantially at the same time, and preceding a step 30 for writing in the memory. Since the processing unit 12 processes only dots that contain information, the time taken to present images of the system that has just been described is not limited by the processing speed. It depends only on the speed at which the instructed or set values of the image generator 6 are generated. Thus, the seven steps 24–30, for one set value, are carried out in the present example within a period of 100 ns corresponding to the providing of the set value comprising the coordinates X, Y, the color and the precise position (half-pixel bits).

Figure 7:
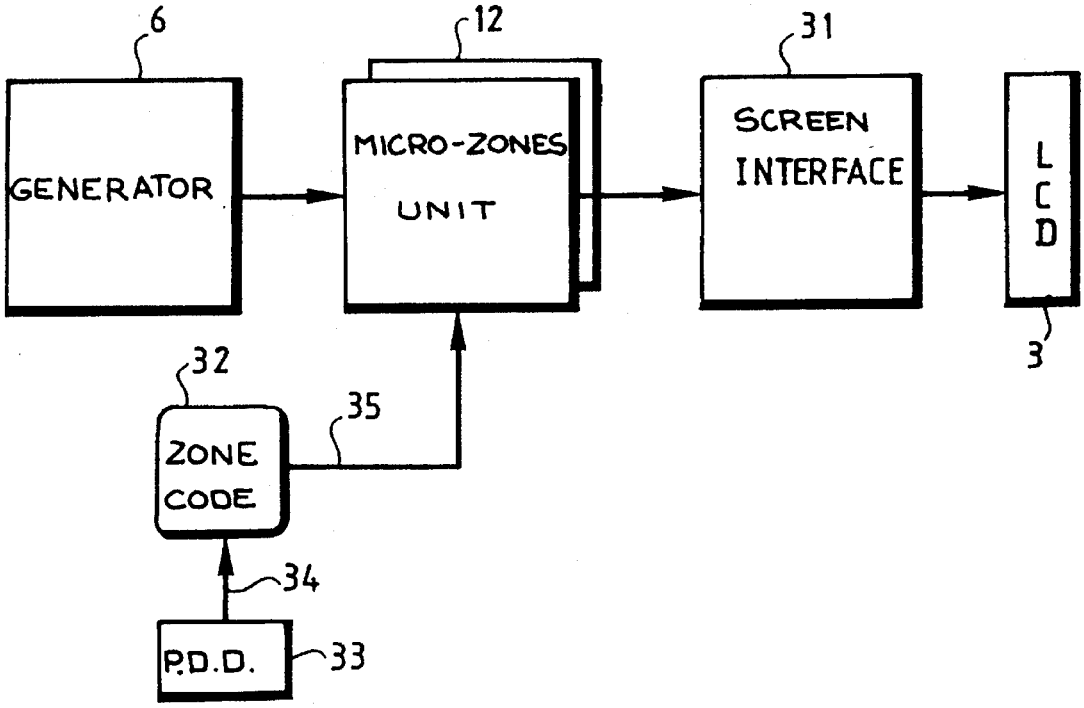
FIG. 7 is a block diagram of the image processing circuit of the device of the invention.

FIG. 7 shows the block diagram of the image processing circuit of the device of the invention. The image generator 6 is connected to the micro-zone processing unit 12, the output of which is connected, through an interface 31, to the liquid crystal color display screen 3. The processing unit is furthermore connected to a zone code generation device 32, controlled by a device 33 for detecting the orientation of the observer's line of sight. This detection device may be one of those described here above. The output of the code generator device 32 is connected to the bus 8A (see FIG. 2).

The zone codes generation device 32 has the roles of:

- interfacing with the position detection device 33, for example through a serial type of computer link 34, in order to receive information elements on the orientation of the observer's line of sight;
- determining, on the basis of these information elements, the zone of the corresponding space and deducing therefrom the zone code to be transmitted;
- transmitting this zone code to the micro-zone processing unit 12, for example through a parallel type computer link 35 (connected to the bus 8A) or directly in the form of discrete bits.

To make this zone code generation device 32, it is possible simply to use a microcomputer, for example of the PC type. To one serial port of this microcomputer, there is connected one of the above-described position detection devices, and one parallel port of this microcomputer is connected to the circuit 12. It is then enough to set up a simple program for the management of the microcomputer to make it fulfil the roles mentioned here above and explained here below.

It is also possible to make the device 32 by means of a dedicated computer, built for example with a microcontroller such as the 68HC11. A program transcribed in machine language and implanted in the read-only memory of the computer then makes it fulfil the same roles as the above-mentioned microcomputer.

The micro-zone generator 8 (FIG. 2) of the unit 12 may be considered to consist of several "catalogs", each catalog being associated with a single code coding the conditions of observation of the screen 3.

Figure 8:
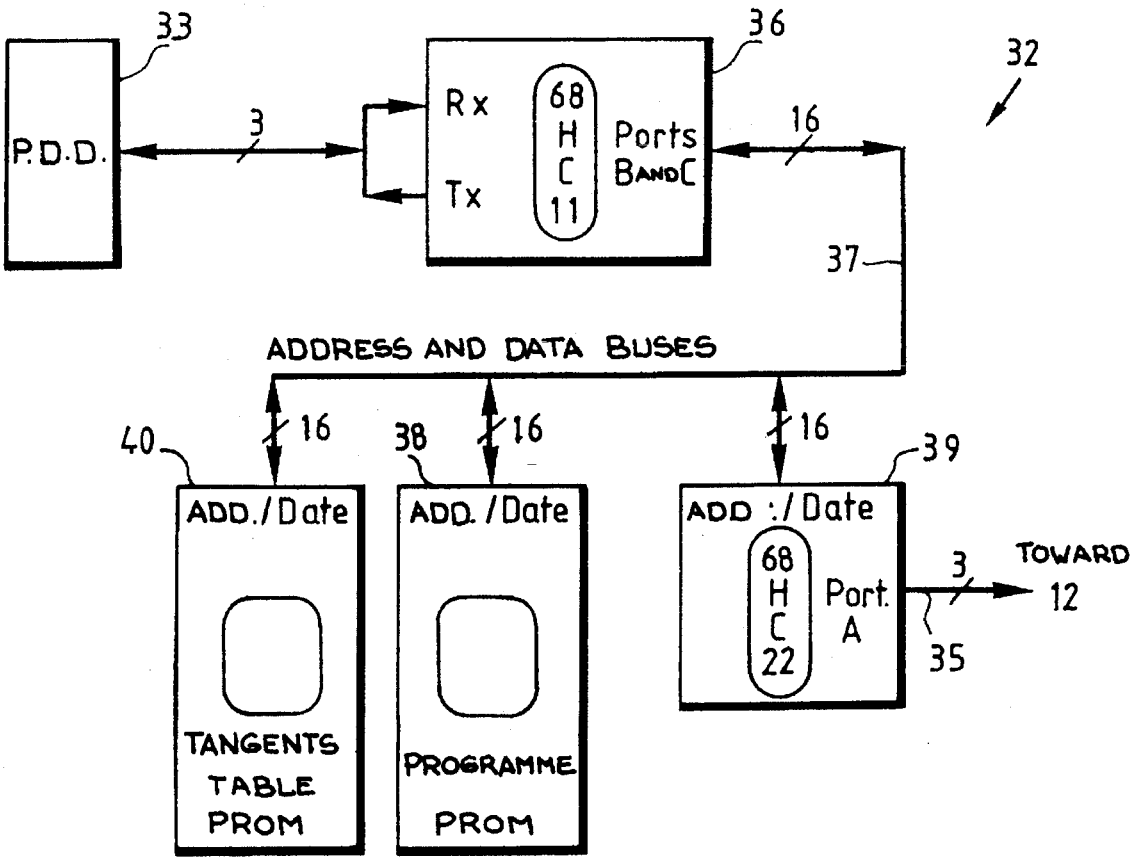
FIG. 8 is a simplified diagram of a dedicated processing unit that can form part of the processing circuit of FIG. 7.

FIG. 8 shows the block diagram of a dedicated computer such as this (the device 5 of FIG. 1). The microcontroller 36 is connected by the serial link 34 to the detector 33. Its address and data buses, given the general reference 37, are connected to a program read-only memory 38, to an interface 39 and to a read-only memory containing a table or catalog of values of tangents of angles of observation and of angles of angular limits. The output of the interface 39 is connected by the link 35 to the unit 12. Through the link 34, the microcontroller 36 receives the coordinates of the detector 33. It makes a search, in the memory 40, for the corresponding values of observation angles (given in detail here below with reference to FIGS. 10 and 11), compares them with the angular limits (as explained here below with reference to FIGS. 10 and 11) and deduces the corresponding zone code therefrom.

In the case of the embodiment using a microcomputer to constitute the unit 32, it is necessary to interpose, between the unit 12 and this microcomputer, an interface that receives the codes of observation conditions from this microcomputer on a parallel computer link.

The unit 32 codes the conditions of observation of the screen as follows. The observation space may be considered to be a hemisphere in front of the plane of the screen. According to the invention, this hemisphere may be divided into zones inside which the observer may be positioned in order to look at the screen. It is assumed that, inside one and the same zone, the observer has practically the same perception of the zone, irrespectively of its position in this zone. With each zone then, there is associated a particular processing of the image of the screen. To simplify the coding it is possible, for reasons of symmetry, to reduce the hemisphere to a quarter hemisphere within which there is defined a horizontal angular boundary and a vertical angular boundary.

An explanation shall be given here below of a simple example of coding associated with the different zones of a hemisphere.

Figure 9:
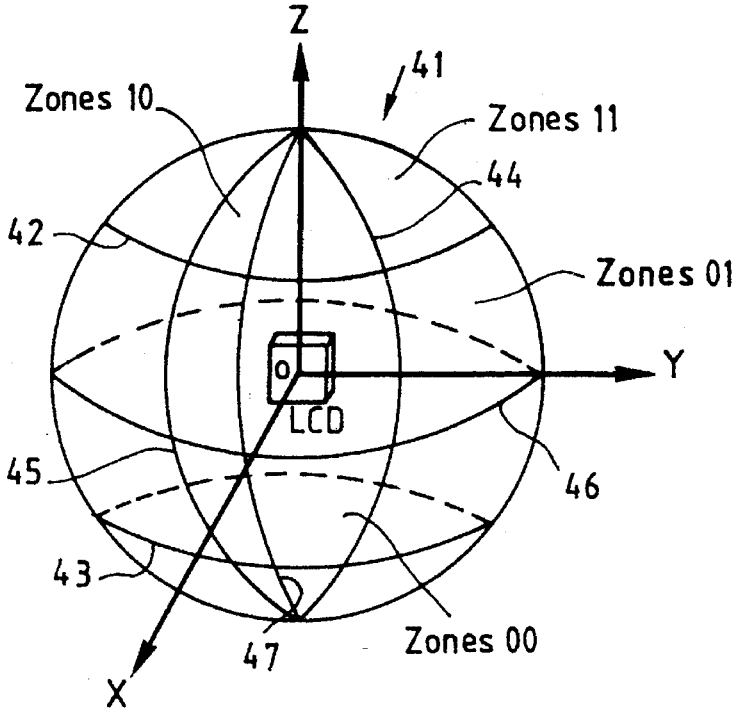
FIGS. 9 to 11 are diagrams illustrating the detection of the direction of observation according to the method of the invention.

FIG. 9 shows an example of the dividing of the hemisphere into elementary zones. The center of the LCD screen 3 is made to coincide with the origin 0 of the axes of a spatial system of Cartesian coordinates Ox, Oy, Oz, the plane (xOy) being the plane of the screen and of the drawing. The axis Oz points towards the top of the screen, the axis Oy towards the right and the axis Ox towards the observer of the drawing and of the screen. The hemisphere of observation 41, centered at 0, has been plotted on this figure. On this hemisphere, two horizontal angular limits or "parallels" 42 (with positive ordinate value in relation to the z axis) and 43 (with negative ordinate value in relation to the z axis) have been plotted. The absolute value of the "latitude" of these angular limits is for example 45° Furthermore, vertical angular limits ("meridian lines") 44 (with positive abscissa value in relation to the y axis) and 45 (with negative abscissa value in relation to the y axis) have been plotted. The absolute value of the longitude of these limits is for example also 45°. The planes (xOy), (yOz) and (zOx) divide this hemisphere into four quarters of a hemisphere. In each of these quarters, two of the corresponding angular limits determine four observation zones. The parallel having the latitude 0° (the "equator") is referenced 46< and the meridian line in the plane (Oz, Oy) is referenced 47. We shall examine, for example, the quarter of a hemisphere for which all the points have positive coordinates.

A first observation zone, coded 00, is demarcated by the limits 46, 47 and the limits 42 and 44. The second zone, coded 01, is demarcated by 42, 44, 46 and the plane (yOz). The third zone, coded 10, is demarcated by 44, 42 and 47. The fourth zone, coded 11, is the remaining zone, i.e. the zone demarcated by 44, 42 and the plane (yOz). The determination of the zones for the other three hemisphere quarters is deduced by symmetry with respect to the plane (zOx) or (xOy).

Naturally, the number of zones of the hemisphere is not necessarily four, and may be greater than this value. This number can be adapted as a function of the measured performance characteristics of the screen, or as a function of the ambient conditions (temperature, luminosity etc.) and/or as a function of the images displayed on the screen.

Thus, to code the direction of observation of the screen 3, it suffices to connect the observer's head (or eye) to the center 0 by a straight line and to determine the zone through which this straight line passes.

It is then possible to draw up the table below, in which the terms "higher limits" and "lower limits" refer to the fact that the observer's angular position is higher or lower than the limit considered. The codes, naturally, are chosen arbitrarily.

Thus, for example, for the zone 01, the observer's angular position is lower (in terms of absolute value) than the angular position of the horizontal limits 42, 43 (lower than 45° in the above-mentioned example) and higher (in terms of absolute value) than the angular position of the vertical limits 44, 45 (higher than 45° for the above-mentioned example.

| code | Vertical limit | Horizontal limit |
|---|---|---|
| 0 | lower | lower |
| 1 | higher | lower |
| 0 | lower | higher |
| 1 | higher | higher |

In concrete terms, a position sensor 48 of one of the above-mentioned types is set on the observer's head, and the direction of observation is defined as a straight line connecting the position sensor to the center of the screen.

Figure 10:
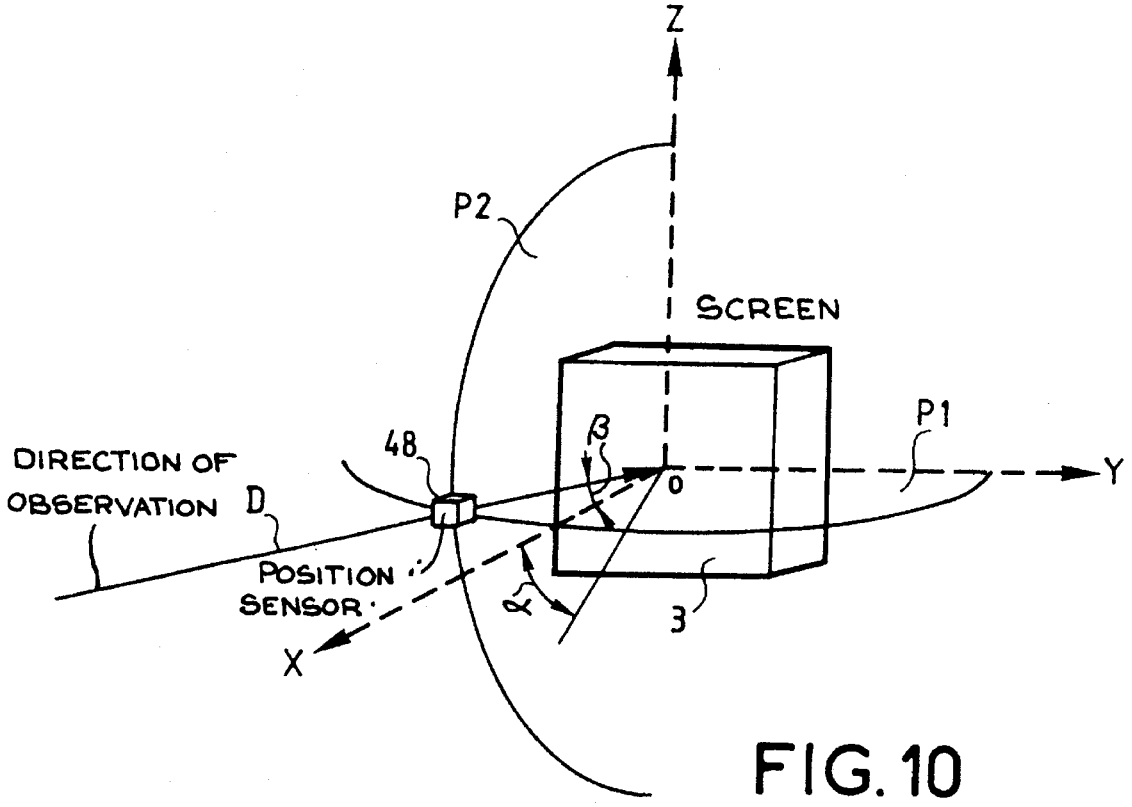

This straight line is the result of the intersection of two planes, a horizontal plane P1 called the "azimuth" (the rotation of the sensor about the axis Oz), defined by the "direction of observation" straight line D and the axis Oy, and a vertical plane P2, called the "elevation" (rotation of the sensor about the axis Oy) defined by the "direction of observation" straight line and the axis Oz (FIG. 10).

The direction of observation is perfectly determined if it is possible to measure two angles, an angle $\alpha$ defined as being the angle between the "elevation" plane and the plane xOz, and an angle $\beta$ defined as being the angle between the "azimuth" plane and the plane xOy.

A simple trigonometrical computation, on the basis of the coordinates x, y, z coming from the position sensor, enables the angles $\alpha$ and $\beta$ to be determined.

Figure 11:
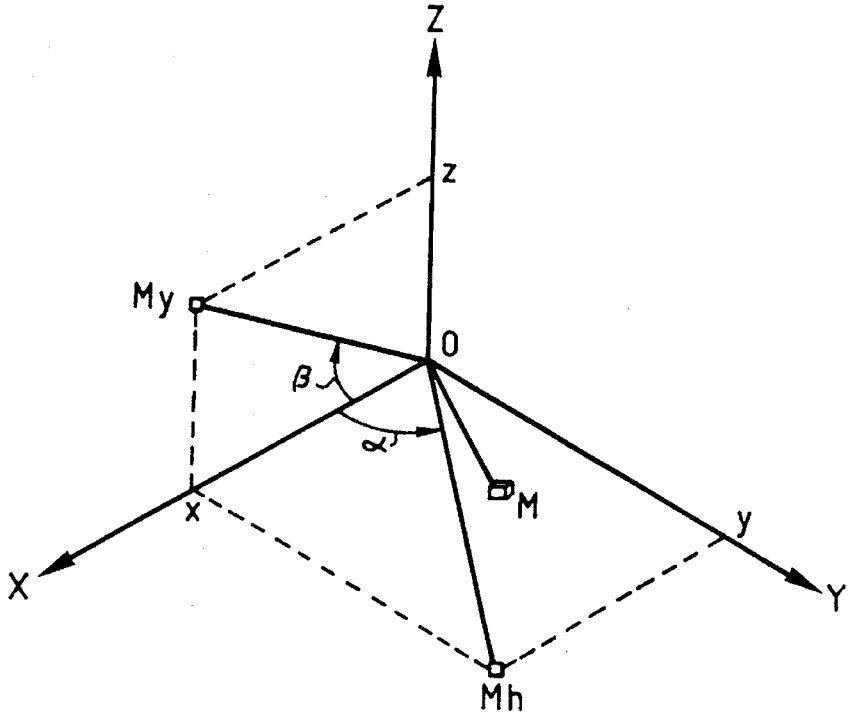

The angles $\alpha$ and $\beta$ are computed by the projection of the position M of the sensor on the planes xOz (point Mv) and xOy (point Mh) (see FIG. 11).

We thus determine:

$\alpha$=ATAN (y/x)

$\beta$=ATAN (z/x)

(ATAN being the arc tangent function and x, y, z being the coordinates of the observer's position in the reference system Oxyz.

These angles defining the direction of observation will make it possible, by comparison with the angular limits of the zones of space, to determine the code to be transmitted to the unit 12.

To determine the angular value of the limits of zones it is possible, initially, to fix the angular limits of the zones arbitrarily at b 45°, and use the sets of micro-zones computed on the basis of the measurements of the electro-optical response of the display unit, as a function of the angle of sight, in the horizontal and vertical planes.

The position of the limits could then be defined with finer precision according to the results of an evaluation test in which a test figure is presented on the display unit to a population of observers who will be required to judge the legibility of this test figure.

According to the above-mentioned example, only two bits are used to code the conditions of observation relative to the user's position, thus defining four different zones of the observation space and, hence, four different types of processing (or sets of micro-zones).

A set of micro-zones is formed, for example, by 1024 micro-zones computed as a function of the color to be generated, the characteristics of the display unit used and the definition of the image generator with respect to that of the display unit.

A micro-zone is itself a polygon comprising several pixels, for example 1024 pixels.

Figure 12:
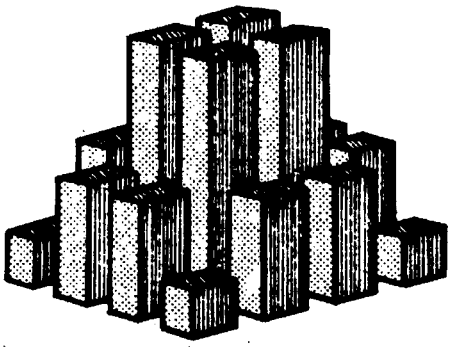
FIG. 12 is a set of graphs showing four examples of values of amplitudes of zones of a set of micro-zones as a function of different angles of observation.
Figure 12:
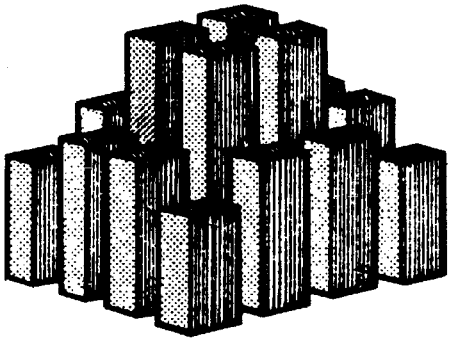
Figure 12:
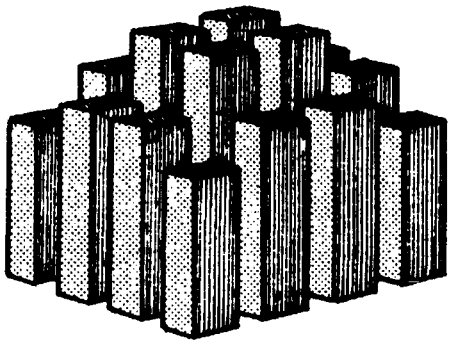
Figure 12:
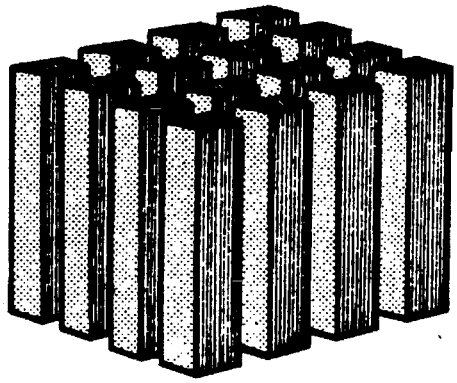

FIG. 12 shows a simplified example (4×4 micro-zones) of four zones of micro-zones corresponding to the above-mentioned four zones. The following are the codes of these zones:

Code 00 zones:

These zones correspond to a direction of observation close to the normal to the screen. In these regions, the response of the display unit is the optimum, and the processing of the image is done with a view to improving its quality (by anti-aliasing, irisation etc.). In this case, a set of micro-zones known as reference micro-zones is used. The luminance levels of the different micro-zones of the set of micro-zones have a substantially Gaussian shape, taken along their diagonals.

Code 01 zones:

The direction of observation diverges sharply from the normal to the screen in the horizontal plane. In this case, the display unit begins to show a lowered quality of response (reversal of contrast for the low level gray shades, colorimetrical drift etc.). Visually, the apparent thickness of the lines displayed tends to diminish. It therefore becomes necessary, to ensure the legibility of the image, to modify the processing applied to it by using a set of micro-zones, the luminosity profile of which has been slightly enhanced.

Code 10 zones:

The direction of observation diverges sharply from the normal to the screen in the vertical plane. As above, the display unit has difficulties in giving accurate displays of the images. In practice, it is seen that the electro-optical response of an LCD screen is not symmetrical. The angle of sight is generally more limited in the vertical plane than in the horizontal plane. This is why the invented device permits processing operations that are different for the horizontal and vertical planes. For these zones, therefore, a set of micro-zones with medium enhancing is used.

Code 11 zones:

The direction of observation diverges sharply from the normal to the screen in both planes. In this most unfavorable example of observation, if it is desired to ensure the legibility of the image, it is necessary to use a set of saturated micro-zones (with no gray level). The quality of the image is, of course, slightly lowered but this is of no importance given the conditions of observation.

The device of the invention works in real time. In fact, the specifying of the conditions of observation as far as the direction of observation is concerned is limited solely by the speed with which the position detecting system measures the observer's position.

Thus, for the exemplary embodiment (LCD screen with 1024×1024 pixels, with quad distribution of the image dots, and a dynamic range of sixteen luminance levels), the observer's position is measured at the frequency of 30 Hz (i.e. every 33 ms), the computation and the transfer of the code to be applied to the unit is done in 1 ms, and a modification of the observation conditions will be taken into account by the unit 12 at 100 Hz (i.e. every 10 ms).

It is thus seen that, with the device of the invention, the image can be adapted to the observer in 1/30th of a second, which is sufficient even for fast movements on the part of the user.

What is claimed is:

1. A method for the optimizing of the performance characteristics of a liquid crystal display matrix screen as a function of an angle of observation of an image on the screen by an observer, comprising the steps of:

representing the observation space before the screen as a hemisphere and dividing the observation space into elementary zones corresponding to different angular positions, relative to the screen, in which the observer may be placed in order to look at the image, associating a particular processing operation of the image to be shown on the screen with each zone;

determining, for each zone, a set of micro-zones that are each formed by several pixels of the screen;

determining, for elementary zones, a luminance level of each pixel and a chrominance level of each micro-zone of the screen memorizing the determined values; then, detecting a position of the observer with respect to the screen; and modifying at least one of the parameters of the processing of the image to be presented on the screen as a function of the values that are memorized and that correspond to the detected angle of observation.

2. A method according to claim 1, wherein the elementary zones are demarcated by longitudinal latitudinal angular limits.

3. A method according to claim 2, wherein the step of detecting the position of the observer with respect to the screen Comprises determining by means of a sensor which gives the observers coordinates in a system of spatial Cartesian coordinates relative to the screen, and converting those coordinates into two angles relative to the screen, said two angles including an angle $\alpha$ between a vertical plane normal to the screen and passing through the center of the screen and a vertical plane passing through the center of the screen and through the sensor, and an angle ($\beta$) between a horizontal plane normal to the screen add passing through the center of the screen and a plane passing through the sensor and through the center of the screen, these angles defining the direction of observation, and further comprising the steps of;

comparing these angles with the angular limits of the elementary zones to determine the elementary zone corresponding to the observer's position; and activating processing corresponding to this zone.

4. A method according to one of the above claims, wherein action is taken on at least one of the following parameters of the screen: luminance or chrominance.

5. A device for optimizing the performance characteristics of a liquid crystal display matrix screen, comprising:

a detector for detecting an observer's relative angular position relative to a direction which is perpendicular to a surface of the screen;

a processor for determining from the relative angular position of the observer, angle weighting control signals for controlling image production on the screen as a function of the relative angular position, said processor coupled to said detector;

an image characteristic weighting unit, coupled to an output of said processor, for weighting image generation signals according to the determined angle weighting control signals, the weighting image generation signals coupled to said screen for providing images on the screen.

6. A device according to claim 5, wherein said processor comprises memories for storing angle weighting control signals for different relative angular positions of the observer.

* * * * *